United States Patent [19]

Zeilinger

[11] Patent Number: 4,852,228

[45] Date of Patent: Aug. 1, 1989

[54] METHOD OF MANUFACTURING A VEHICLE SEAT WITH MOLD-IN-FACE SUSPENSION SYSTEM

[75] Inventor: Randy A. Zeilinger, Ypsilanti Township, Washtenaw County, Mich.

[73] Assignee: Hoover Universal, Inc., Ann Arbor, Mich.

[21] Appl. No.: 113,651

[22] Filed: Oct. 26, 1987

[51] Int. Cl.[4] ..... B68G 7/00

[52] U.S. Cl. ..... 29/91.1; 29/458; 156/245; 156/285; 264/41

[58] Field of Search ..... 29/91.1, 91.5, , 91.7, 29/458; 264/41; 297/452; 156/245, 285

[56] References Cited

U.S. PATENT DOCUMENTS 3,932,252 1/1976 Woods ..... 29/91.1 X 4,718,153 1/1988 Armitage et al. ..... 29/91.1

*Primary Examiner*—Timothy V. Eley

*Attorney, Agent, or Firm*—Harness, Dickey & Pierce

[57] ABSTRACT

A vehicle seat assembly including a seat cushion suspension assembly consisting of a flexible elastic fabric sheet having a foam body molded thereto forming a bun. The bun is formed by attaching the fabric sheet to retainers and in turn the retainers to spaced apart receivers on the inside of a mold. The mold is closed, expandable foam is injectd, and the positioned fabric sheet is thus molded to and bonded to the fabric. The bun so formed is then positioned on a vehicle seat frame by attaching the retainers to laterally separated side rails of the frame thus forming a support for seating loads.

5 Claims, 2 Drawing Sheets

METHOD OF MANUFACTURING A VEHICLE SEAT WITH MOLD-IN-FACE SUSPENSION SYSTEM

BACKGROUND AND SUMMARY OF THE INVENTION

This invention relates generally to the field of seating and more particularly to vehicle seat assemblies. Previously, most vehicle seating involved the use of a frame having an arrangement of springs upon which a padding such as foam rubber was positioned. This seat is then covered with a fabric or other sheet material which is attached to the frame. In a co-pending application Ser. No. 437,715, filed Oct. 29, 1982, commonly assigned, a seat assembly is disclosed having a foam encapsulated load supporting fibrous matrix stretched between laterally spaced frame members of a seat. In this seat assembly the foam pad is molded in place onto the load supporting fibrous matrix that is prepositioned on the frame. Thus, the foam encapsulating covers both the fibrous matrix or fabric sheet and the side rails of the frame upon which the seat cushion is to be mounted.

The seat assembly of the above mentioned copending application must be positioned partially inside a mold cavity where the foam is injected to expand the foam pad over the fabric matrix and portions of the frame.

In contrast, the present invention provides a vehicle seat cushion suspension assembly that will be mounted on a frame having laterally separated side rails but which is produced without the necessity of premounting the fabric shett between the side rails of a vehicle seat frame. The result is a vehicle seat cushion suspension assembly that is more versatile and simpler to produce. In addition, the elimination of the requirement for a mold to accommodate the seat frame permits the mold to be smaller and more compact as well as enabling one mold to be utilized for a variety of seating configurations. The frame thus is not a constraint to the mod configuration in the present invention.

The vehicle seat cushion suspension assembly of this invention for carrying seating loads on a vehicle seat having laterally separated side rails comprises a flexible elastic woven fabric material, generally rectangular in shape, having a foam body integrally molded and bonded thereto. The load supporting fabric sheet is formed of woven flexible elastic filaments. A foam cushion body is integrally molded and bonded to the fabric such that the fabric and the foam body molded together act in concert to elastically support seating loads when the assembly is mounted on and positioned between side rails of a vehicle seat frame. The fabric material effectively transfers the loads from the cushion to the side rails while the foam in the body functions to lock all of the filaments together to provide for the desired distribution of seating loads throughout the sheet and avoid areas of stress concentration.

The vehicle seat cushion suspension assembly of this invention applies equally well to the formation of the vehicle seat back. A seat back assembly having laterally separated side rails may also have a flexible elastic fabric supported between them with a foam body integrally molded and bonded thereto that act together to support seating loads on the seat back.

The seat cushion suspension assembly according to the present invention is produced in a foam mold. The flexible woven fabric sheet is mounted inside one-half of a hollow mold, the other half of the mold is closed over the first half, the expandable foam is injected into the mold cavity. As the foam expands and encapsulates the fabric contained therein the fabric is effectively bonded to the foam body formed therein. The mold is then opened and the foam body with fabric attached is removed. The fabric sheet, with the foam body integrally molded and bonded thereto can then be attached to the side rails of a seat frame.

In addition, once the foam body with the fabric sheet bonded thereto is removed from the mold a seat trim sover may then be bonded to the foam body. This is done by takin a preformed seat trim cover having a complimentary shape to that of the outside surface of the foam body, coating the cover or the body with adhesive, and positioning the seat trim cover onto the frame body in complimentary relation and then applying heat and pressure which bonds the seat cover to the foam pad or body.

The resulting assembly can then be mounted on a seat frame such that the fabric sheet is suspended between side rails of the frame and the edges of the seat cover may be wrapped around and attached to the underside of the seat frame thus completing the seat assembly.

Further objects, features, and advantages of this invention will become apparent from a consideration of the following detailed description when taken in conjunction with the appended claims and accompanying drawings.

DETAILED DESCRIPTION OF THE PREFERRED EMBODIMENT

Figure 1:
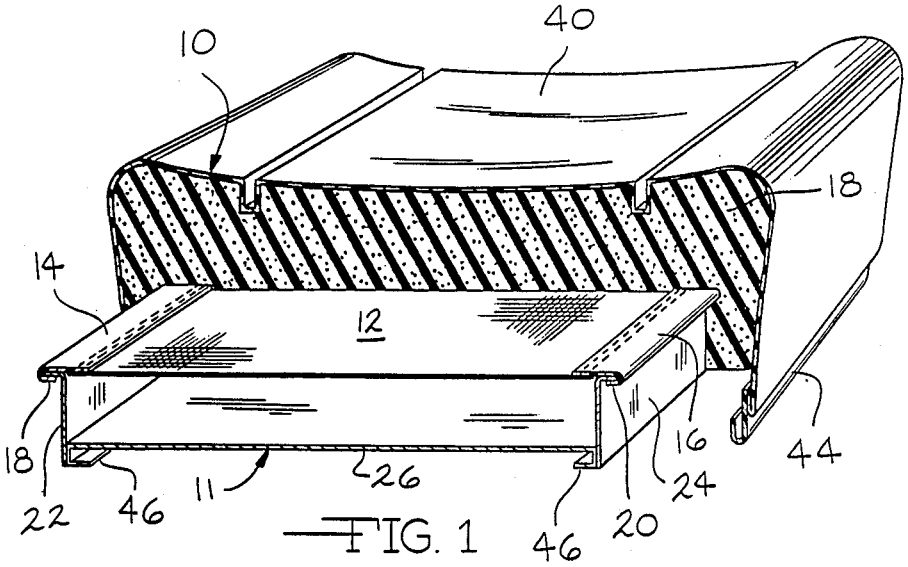
FIG. 1 is a fragmentary perspective view of a portion of a seat assembly of this invention, with some parts broken away and other parts shown in section for the purpose of clarity.

Turning now to the drawings, the vehicle seat cushion suspension assembly or bun 10 as shown in FIG. 1 mounted on frame assembly 11. Bun 10 is comprised of flexible elastic fabric sheet 12 which is generally rectangular in shape. Sewn to opposite edges of fabric sheet 12 are retainers 14 and 16 constructed from a plastic strip having a J-shaped cross section. Molded and bonded to sheet 12 with retainers 14 and 16 attached, is foam body 18.

Bun 10 is mounted on frame assembly 11 by hooking the short legs of J-shaped retainers 14 and 16 over receivers or flanges 18 and 20 on side rails 22 and 24 respectively of frame assembly 11. Side rails 22 and 24 are maintained in spaced apart relation by horizontal frame member 26.

Retainers 14 and 16 may also be snaps, hooks, rivets, barbed tabs, or other attachment means for connecting to corresponding receivers on side rails 22 and 24. However, in this preferred embodiment, J-strips and flanges are used.

Figure 2:
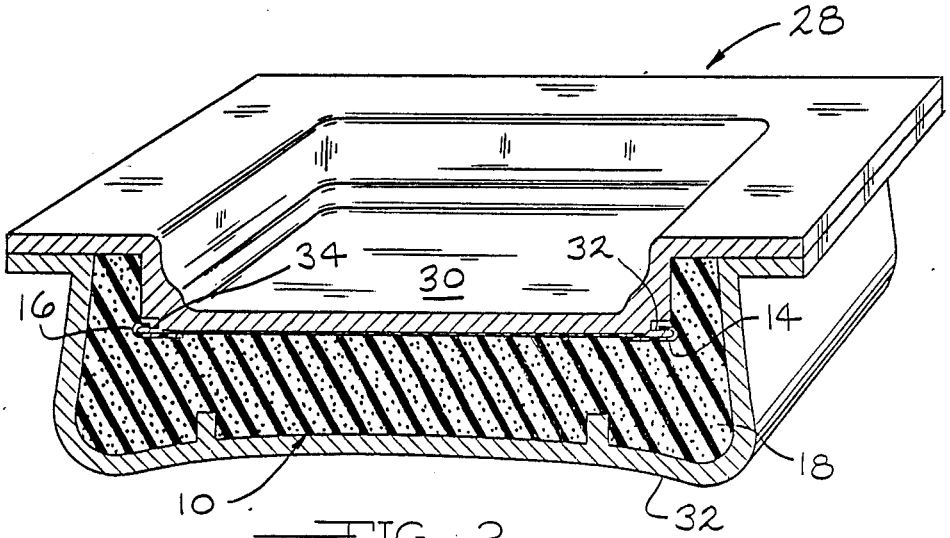
FIG. 2 is a fragmentary perspective view of the vehicle seat cushion suspension assembly of this invention in a mold shown in section for the purpose of clarity.

Bun 10, comprising fabric sheet 12, retainers 14 and 16, and foam body 18 is formed in mold 28, shown in FIG. 2. Mold 28 includes a first mold half member 30 having spaced apart flanges 32 and 34 on the inside surface of mold member 30. Flanges 32 and 34 are spaced apart the same distance and are oriented the same as flanges 18 and 20 on frame assembly 11. Thus when fabric sheet 12 is attached between flanges 32 and 34 by hooking retainers 14 and 16 over flanges 32 and 34, fabric 12 is positioned in the same configuration within the mold cavity as the fabric sheet will be positioned when attached to frame 11.

A second mold half member 32 is closed against member 30 completing the mold enclosure. An expandable foam material is injected into the mold. The foam expands to fill the mold interior. In so doing, foam body 18 is bonded to fabric sheet 12 completing the assembly of the bun 10. Mold halves 30 and 32 are then separated, and the completed bun may then be slid off of flanges 32 and 34 or alternately the bun may be flexed to disengaged the J strips 14 and 16 from flanges 32 and 34. This molding operation effectively encapsulates the flexible fabric sheet with the J-shaped retainers attached.

The foam body 18 bonded to fabric sheet 12 functions to lock all of the filaments together to provide for the desired distribution of seating loads throughout sheet 12 and avoid areas of stress concentration when the bun 10 in mounted on the frame assembly 11. Fabric sheet 12 is preferably stretched taut between flanges 32 and 34 in mold member 30. Correspondingly, when the bun is mounted on frame assembly 11, fabric 12 will be stretched between side rails 22 and 24.

The completed bun 10, removed from mold half 30 may then be placed on a bonding machine die also having spaced apart flanges corresponding to the width between side rails 22 and 24. The outer surface 36 of bun 10 may then be coated with a suitable adhesive or the inside surface 38 of a fabric trim cover 40 so coated. The trim cover 40 is then applied to bun 10 by positioning the trim cover which has a complimentary shape to the shape of the outer surface of the bun onto a bonding machine die 42 and then pressing the die against the bun. In addition, heat may be applied to the trim cover 40 through the bonding machine die to speed the bonding process.

Figure 3:
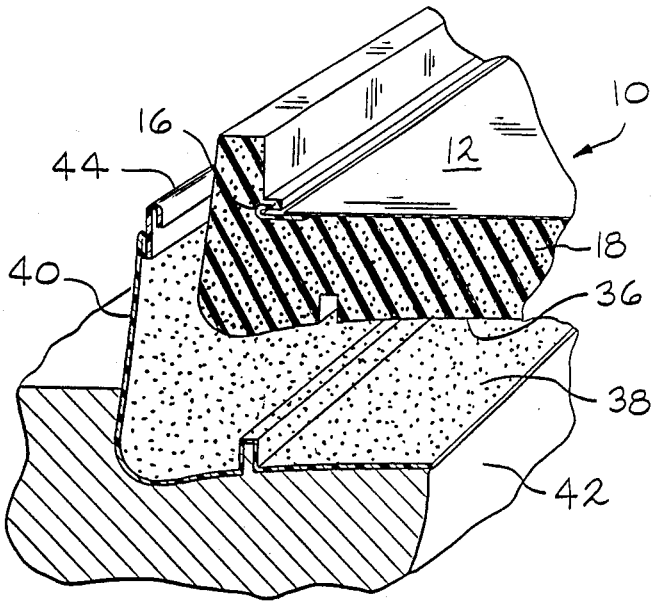
FIG. 3 is a partial sectional view of the vehicle seat suspension assembly of the present invention showing a seat cover in complimentary relation to the foam pad.
Figure 4:
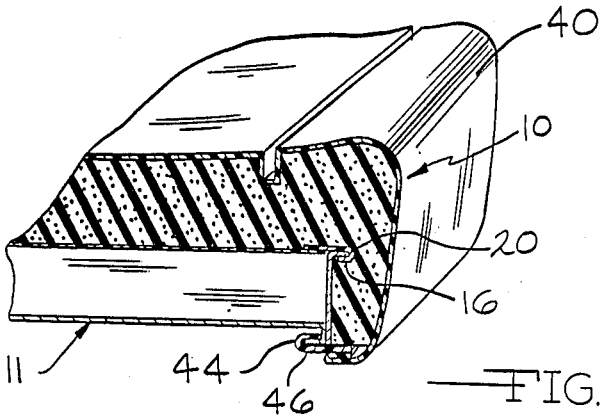
FIG. 4 is a fragmentary perspective view of a portion of the completed seat assembly of this invention.

As shown in FIG. 3, the trim cover position in the bonding machine die 42 has a complimentary surface relationship to the surface 36 of bun 10. The completed vehicle seat cusion assembly with trim cover attached can then be positioned on frame 11 as shown in FIG. 1. To complete the assembly, J-shaped retainer strips 44, presewn to the edges of trim cover 40 are then hooked over flanges 46 on frame assembly 11 as shown in FIG. 4. The completed assembly may then be mounted on a vehicle seat or back frame and mounted within the vehicle.

From the above description, it is seen that this invention provides an improved versatile vehicle seat with a molded in place suspension system to provide a wide distribution of seating loading forces when applied to the seat cushion. A seat or back with improved comfort, versatility and ease of manufacture is thus achieved.

What is claimed is:

1. A method of manufacturing a vehicle seat cushion suspension assembly for mounting on a frame having laterally separated side rails, said method comprising the steps of:

(a) providing a rectangular woven elastic fabric sheet having retaining means attached to a pair of opposing edges of said fabric sheet;
(b) positioning said sheet within a mold cavity;
(c) injecting expandable foam into said mold to form a foam body molded and bonded to said sheet; and
(d) removing said body from said mold with said fabric molded and bonded to said body.

2. The method according to claim 1 wherein the step of positioning said sheet further comprises stretching said sheet between a pair of laterally separated support members fixed within said mold and attaching said retaining means to said support members thereby tensioning said sheet.

3. The method according to claim 1 wherein said retaining means comprises a pair of plastic strips each having a J-shaped cross section, the method further comprising the step of sewing one of said strips to each of said pair of edges of said fabric sheet.

4. A method of manufacturing a vehicle seat assembly comprising a frame having laterally separated side rails, a load supporting elastic fabric sheet stretched between said rails, a foam body molded and bonded in place on said sheet stretched therebetween, and a seat cover positioned over said body and said rails and secured to said frame, said method comprising the steps of:

(a) attaching retainers to two opposite edges of said fabric sheet;
(b) stretching said sheet and fastening said retainers onto spaced apart mounting members within a first mold member thereby mounting said sheet within said first member;
(c) positioning a second mold member onto said first mold member to form a mold enclosing said sheet;
(d) injecting expandable foam into said mold to form said foam body molded and bonded to said sheet;
(e) removing said body from said mold with said stretched fabric molded and bonded to said body;
(f) coating said body with an adhesive;
(g) placing a set trim cover having a complimentary shape to the shape of the outer surface of said foam body in complimentary position on said foam body;
(h) bonding said seat cover to said body; and
(i) attaching said fabric sheet to said rails and said seat trim cover to said frame thereby completing the assembly of said vehicle seat.

5. The method of manufacturing a vehicle seat assembly according to claim 4 wherein the step of stretching said sheet tensions said sheet between said spaced apart mounting members within said first mold member.

* * * * *

UNITED STATES PATENT AND TRADEMARK OFFICE

CERTIFICATE OF CORRECTION

PATENT NO. : 4,852,228

DATED : August 1, 1989

INVENTOR(S) : Randy A. Zeilinger

It is certified that error appears in the above-identified patent and that said Letters Patent is hereby corrected as shown below:

IN THE TITLE, line 2, "FACE" should be --PLACE--.
In the Abstract, line 7, "injectd" should be --injected--.
Column 1, line 21, "encapsulating" should be --encapsulation--.
Column 1, line 32, "shett" should be --sheet--.
Column 1, line 39, "mod" should be --mold--.
Column 2, line 11, "sover" should be --cover--.
Column 2, line 12, "takin" should be --taking--.

Column 2, line 16, "frame" should be --foam--.

Column 2, line 48, "as" should be --is--.

Column 3, line 44, "position" should be --positioned--.

Column 3, line 47, "cusion" should be --cushion--.
Column 4, line 47, "set" should be --seat--.

Signed and Sealed this

Fourth Day of December, 1990

*Attest:*

HARRY F. MANBECK, JR.

*Attesting Officer*

*Commissioner of Patents and Trademarks*